US009309740B2

(12) United States Patent
June

(10) Patent No.: US 9,309,740 B2
(45) Date of Patent: Apr. 12, 2016

(54) SUBSEA COMPLETION WITH CROSSOVER PASSAGE

(71) Applicant: OneSubsea IP UK Limited, London (GB)

(72) Inventor: David R June, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 14/335,687

(22) Filed: Jul. 18, 2014

(65) Prior Publication Data

US 2016/0017680 A1 Jan. 21, 2016

(51) Int. Cl.

| | |
|---|---|
| ***E21B 33/038*** | (2006.01) |
| ***E21B 33/043*** | (2006.01) |
| ***E21B 43/01*** | (2006.01) |

(52) U.S. Cl.

CPC ..... *E21B 33/038* (2013.01); *E21B 33/043* (2013.01); *E21B 43/01* (2013.01)

(58) Field of Classification Search

CPC ..... E21B 33/038; E21B 33/043; E21B 43/01; E21B 34/04; E21B 41/0035; E21B 41/0042

See application file for complete search history.

(56) References Cited

U.S. PATENT DOCUMENTS

| | | | | |
|---|---|---|---|---|
| 2003/0056956 | A1 * | 3/2003 | Collie et al. | 166/336 |
| 2003/0102135 | A1 | 6/2003 | Baskett et al. | |
| 2004/0104024 | A1 * | 6/2004 | Kent et al. | 166/85.4 |
| 2005/0205262 | A1 * | 9/2005 | Reimert et al. | 166/348 |
| 2010/0206547 | A1 * | 8/2010 | Donald et al. | 166/91.1 |
| 2011/0226483 | A1 * | 9/2011 | Donald et al. | 166/344 |
| 2012/0048567 | A1 * | 3/2012 | June | 166/368 |

OTHER PUBLICATIONS

International Search Report and Written Opinion of PCT Application No. PCT/EP2015/063800 dated Nov. 18, 2015: pp. 1-10.

* cited by examiner

*Primary Examiner* — James G Sayre

(74) *Attorney, Agent, or Firm* — Chamberlain Hrdlicka

(57) ABSTRACT

A system, in some embodiments, for producing well production fluids through a tubing hanger connected with a production tubing string. The system includes a subsea tree with a production flow passage and a tree annulus flow passage. The system also includes a spool assembly separate from the subsea tree that includes a body with a longitudinal passage configured to receive and support the tubing hanger, there being an annulus between the production tubing string and the body. The spool assembly also includes a lateral flow passage extending from the spool longitudinal passage and configured to transfer the production fluids. Further, the system includes an annulus flow passage extending externally from the spool assembly and in fluid communication with the annulus.

12 Claims, 6 Drawing Sheets

SUBSEA COMPLETION WITH CROSSOVER PASSAGE

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, oil and natural gas have a profound effect on modern economies and societies. Indeed, devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, companies often invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, hangers, valves, fluid conduits, and the like, that control drilling and/or extraction operations.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
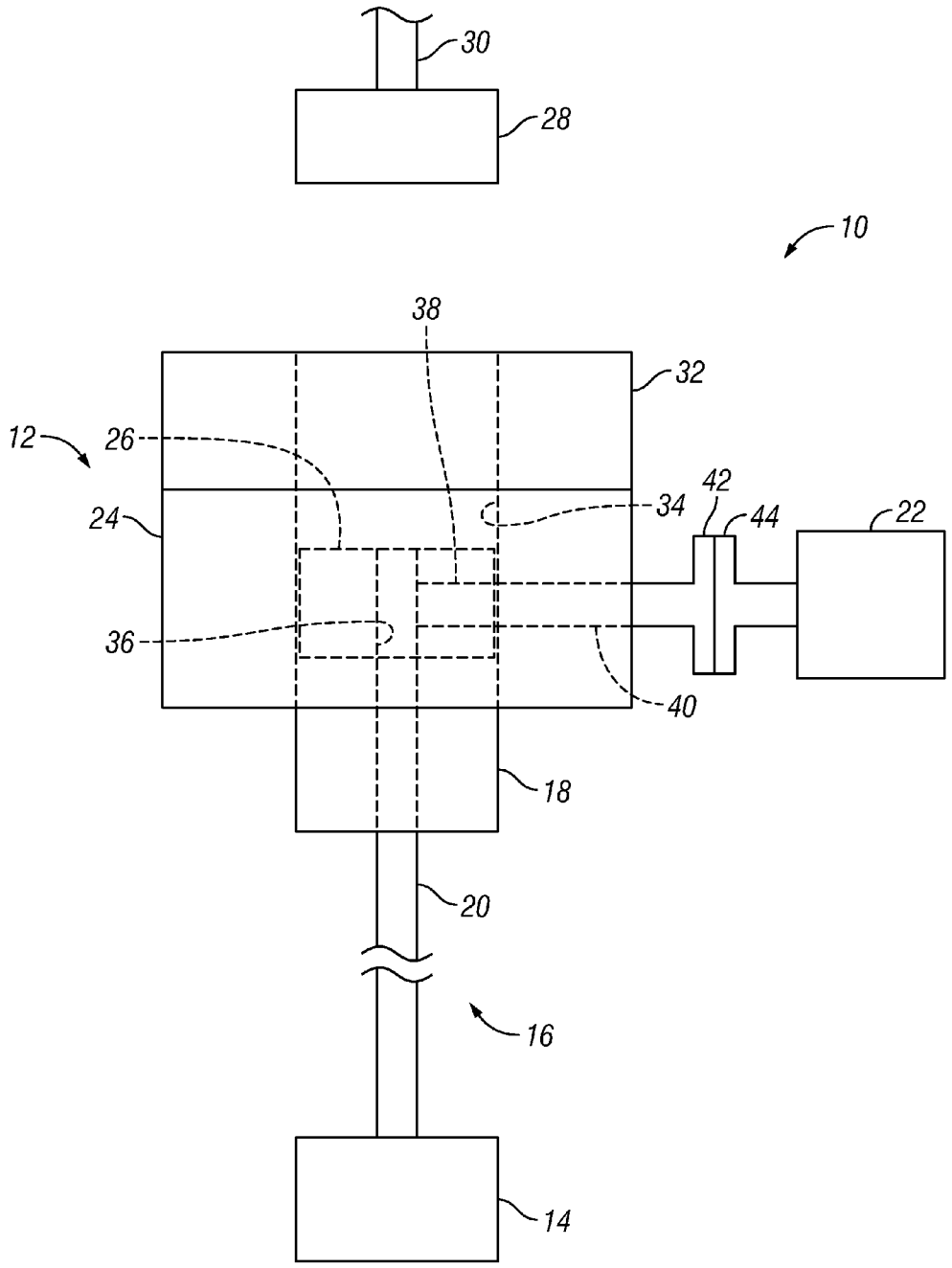
FIG. 1 is a block diagram that illustrates an exemplary mineral extraction system.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

Various arrangements of production control valves may be coupled to a wellhead in an assembly generally known as a tree, such as a vertical tree or a horizontal tree. With a vertical tree, after the tubing hanger and production tubing are installed in the high pressure wellhead housing or a spool assembly such as a tubing spool, a blowout prevent (BOP) may be removed and the vertical tree may be locked and sealed onto the wellhead. The vertical tree includes one or more production passages containing actuated valves that extend vertically to respective lateral production fluid outlets in the vertical tree. The production passages and production valves are thus in-line with the production tubing.

With a vertical tree, the tree may be removed while leaving the completion (e.g., the production tubing and hanger) in place. However, to pull the completion, the vertical tree must be removed and replaced with a BOP, which involves setting and testing plugs or relying on down-hole valves, which may be unreliable due to lack of use and/or testing. Moreover, removal and installation of the tree and BOP assembly generally requires robust lifting equipment, such as a rig, that may have high daily rental rates, for instance. The well is also in a vulnerable condition while the vertical tree and BOP are being exchanged and neither of these pressure-control devices is in position.

Alternatively, trees with the arrangement of production control valves offset from the production tubing, generally called horizontal trees or spool trees, may be utilized. A spool tree also locks and seals onto the high pressure wellhead housing. However, the tubing hanger, instead of being located in the wellhead, locks and seals in the tree production passage. After the tree is installed, the tubing string and tubing hanger are run into the tree using a tubing hanger running tool. A production passage extends through the tubing hanger, and seals to prevent fluid leakage, thereby facilitating a flow of production fluid into a corresponding production passage in the tree. A locking mechanism above the production seals locks the tubing hanger in place in the tree. With the production valves offset from the production tubing, the production tubing hanger and production tubing may be removed from the tree without having to remove the spool tree from the wellhead housing. Unfortunately, if the tree needs to be removed, the entire completion must also be removed, which takes considerable time and also involves setting and testing plugs or relying on down-hole valves, which may be unreliable due to lack of use and/or testing. Additionally, because the locking mechanism on the tubing hanger is above and blocks access to the production passage seals, the entire completion must be pulled to service the seals.

To manage expected maintenance costs, which are especially high for an offshore well, an operator may select equipment best suited for the expected type of maintenance. For example, a well operator may predict whether there will be a greater need in the future to pull the tree from the well for repair, or pull the completion, either for repair or for additional work in the well. Depending on the predicted maintenance events, an operator will decide whether the horizontal or vertical tree, each with its own advantages and disadvantages, is best suited for the expected conditions. For instance, with a vertical tree, it is more efficient to pull the tree and leave the completion in place. However, if the completion needs to be pulled, the tree must be pulled as well, increasing the time and expense of pulling the completion. Conversely, with a spool tree, it is more efficient to pull the completion, leaving the tree in place. However, if the tree needs to be pulled, the entire completion must be pulled as well, increasing the time and expense of pulling the tree. The life of the well could easily span 20 years and it is difficult to predict at the outset which capabilities are more desirable for maintenance over the life of the well. Thus, an incorrect prediction may significantly increase the cost of production over the life of the well.

Embodiments of the present disclosure may substantially reduce the duration and costs associated with running and retrieving components of a mineral extraction system, such as a subsea tree, a spool assembly and a tubing hanger. For example, in certain embodiments, a wellhead includes a subsea tree and a spool assembly having a longitudinal passage configured to receive a tubing hanger. The spool assembly also includes a lateral flow passage extending from the longitudinal passage and configured to transfer product to the subsea tree. The subsea tree is positioned radially outward from the spool assembly such that the subsea tree does not block a subsea intervention connection or BOP access to the longitudinal passage. In this configuration, the subsea tree and the tubing hanger may be retrieved independently of one another. In certain embodiments, the subsea tree includes multiple valves coupled to a structure circumferentially disposed about the spool assembly. Such a configuration may facilitate enhanced access to various value actuators via a remote operated vehicle (ROV). In alternative embodiments, the subsea tree may include a structure positioned at one circumferential location radially outward from the spool assembly. Such a tree configuration may include a mating hub connection configured to interface with a hub connection of the spool assembly, thereby facilitating transfer of product (e.g., oil, natural gas, etc.) from the spool assembly to the subsea tree. The hub connection and mating hub connection may interface along a plane substantially perpendicular or substantially parallel to the orientation of the longitudinal passage.

Because the subsea tree is positioned radially outward from the spool assembly, the tree may be run and/or retrieved independently from the tubing hanger. Consequently, to perform maintenance operations on the subsea tree, a ship may be deployed to retrieve the tree. In contrast, if a spool tree were utilized, the tubing hanger must be removed prior to retrieving the tree. Consequently, a rig may be employed to retrieve the tubing hanger and spool tree, thereby significantly increasing tree retrieval costs. Furthermore, in the present embodiment, to perform maintenance operations on the tubing hanger or tubing string, a rig may be deployed to retrieve the tubing hanger while leaving the subsea tree in place. In contrast, if a vertical tree were utilized, the tree must be removed prior to accessing the tubing hanger. Because of the expense associated with deploying a rig, a ship is typically used to retrieve the tree. Therefore, retrieving a tubing hanger from a wellhead employing a vertical tree may involve the coordination of multiple vessels, thereby increasing the costs and duration of maintenance operations.

FIG. 1 is a block diagram that illustrates an exemplary mineral extraction system 10. The illustrated mineral extraction system 10 can be configured to extract various minerals and natural resources, including hydrocarbons (e.g., oil and/or natural gas), or configured to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16, wherein the well 16 includes a wellhead hub 18, which can be a high pressure wellhead housing, and a well bore 20. The wellhead hub 18 generally includes a large diameter hub that is disposed at the termination of the well bore 20. The wellhead hub 18 provides for the connection of the wellhead 12 to the well 16.

The wellhead 12 typically includes multiple components that control and regulate activities and conditions associated with the well 16. For example, the wellhead 12 generally includes bodies, valves, and seals that route produced minerals from the mineral deposit 14, provide for regulating pressure in the well 16, and provide for the injection of chemicals into the well bore 20 (down-hole). In the illustrated embodiment, the wellhead 12 includes a subsea tree 22, a spool assembly 24 (e.g., a tubing spool), and a tubing hanger 26. The system 10 may include other devices that are coupled to the wellhead 12, and devices that are used to assemble and control various components of the wellhead 12. For example, in the illustrated embodiment, the system 10 includes a tubing hanger running tool (THRT) 28 suspended from a drill string 30. In certain embodiments, the THRT 28 is lowered (e.g., run) from an offshore vessel to the well 16 and/or the wellhead 12. A blowout preventer (BOP) 32 may also be included, and may include a variety of valves, fittings and controls to block oil, gas, or other fluid from exiting the well in the event of an unintentional release of pressure or an overpressure condition.

As illustrated, the spool assembly 24 is coupled to the wellhead hub 18. Typically, the spool assembly 24 is one of many components in a modular subsea or surface mineral extraction system 10 that is run from an offshore vessel or surface system. The spool assembly 24 includes a longitudinal passage 34 configured to support the tubing hanger 26. In addition, the passage 34 may provide access to the well bore 20 for various completion and workover procedures. For example, components can be run down to the wellhead 12 and disposed in the spool passage 34 to seal off the well bore 20, to inject chemicals down-hole, to suspend tools down-hole, to retrieve tools down-hole, and the like.

Figure 2:
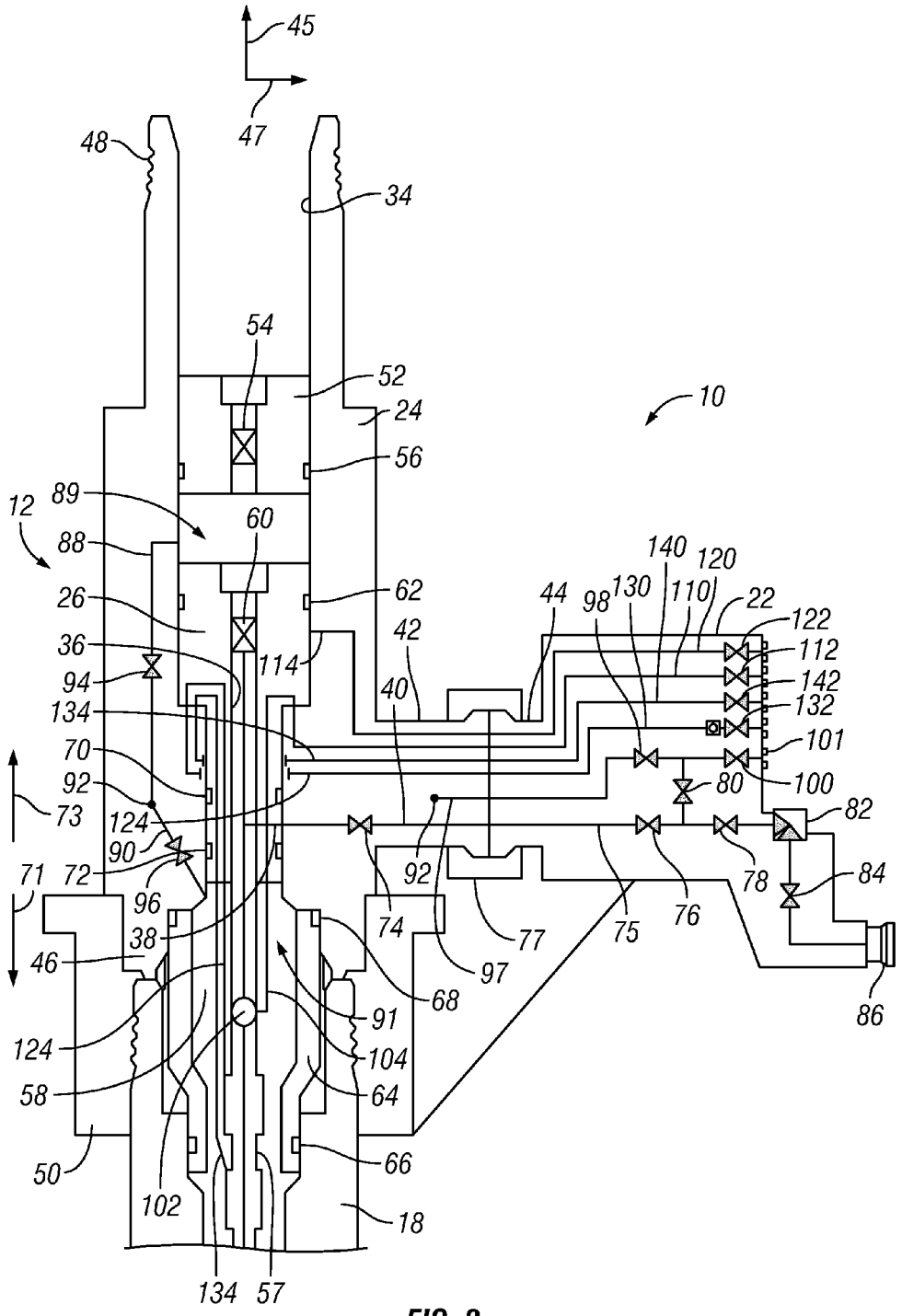
FIG. 2 is a cross-sectional side view of an embodiment of a spool assembly and subsea tree that may be used in the mineral extraction system of FIG. 1.

As will be appreciated, the well bore 20 may contain elevated pressures. For example, the well bore 20 may include pressures that exceed 10,000 pounds per square inch (PSI), that exceed 15,000 PSI, and/or that even exceed 20,000 PSI. Accordingly, mineral extraction systems 10 employ various mechanisms, such as mandrels, seals, plugs and valves, to control and regulate the well 16. For example, the illustrated tubing hanger 26 is typically disposed within the wellhead 12 to secure tubing suspended in the well bore 20, and to provide a path for hydraulic control fluid, chemical injections, and the like. The hanger 26 includes a longitudinal passage 36 that extends through the center of the hanger 26, and that is in fluid communication with the well bore 20. As illustrated in the embodiment of FIG. 2, the hanger 26 also includes a lateral passage 38 in fluid communication with the longitudinal passage 36. The lateral passage 38 of the tubing hanger 26 is configured to transfer product (e.g., oil, natural gas, etc.) from the longitudinal tubing hanger passage 36 to a lateral passage 40 of the spool assembly 24. In the present embodiment, the lateral passage 40 of the spool assembly 24 extends from the longitudinal tubing spool passage 34 to a hub connection 42. The hub connection 42 is configured to interface with a mating hub connection 44 of the subsea tree 22, thereby establishing a flow path from the longitudinal passage 36 of the tubing hanger 26 through the lateral passages 38 and 40 and into the subsea tree 22. While the interface between the hub connection 42 and the mating hub connection 44 is oriented along a plane substantially parallel to the longitudinal passage 34 of the tubing spool assembly 24, it should be appreciated that alternative embodiments may employ an interface along a plane substantially perpendicular to the longitudinal passage 34.

The subsea tree 22 generally includes a variety of flow paths (e.g., passages), valves, fittings, and controls for operating the well 16. For instance, the tree 22 may include a frame, a flow-loop, actuators, and valves. Further, the tree 22 may provide fluid communication with the well 16, such as through the interface between the hub connection 42 and the mating hub connection 44. The subsea tree 22 may also provide for the injection of various chemicals into the well 16 (down-hole), and the like. Further, minerals extracted from the well 16 (e.g., oil and natural gas) may be regulated and routed via the tree 22. For instance, the tree 22 may be coupled to a jumper or a flowline that is tied back to other components, such as a manifold. Accordingly, produced minerals flow from the well 16 to the manifold via the wellhead 12 and/or the tree 22 before being routed to shipping or storage facilities. Because the subsea tree 22 is configured to interface with the spool assembly 24 via the connections 42 and 44, the tree 22 does not include a wellhead hub 18 connection, thereby enabling the subsea tree 22 to be constructed from thinner, lighter and/or less structurally supportive materials. While the subsea tree 22 is positioned at one circumferential position radially outward from the spool assembly 24 in the present embodiment, alternative embodiments may employ a tree 22 circumferentially disposed about the spool assembly 24.

Because the subsea tree 22 is positioned radially outward from the spool assembly 24, the tree 22 may be run and/or retrieved independently from the tubing hanger 26. For example, the THRT 28 may have direct access to the tubing hanger 26 because the tree 22 does not block the longitudinal spool passage 34. As a result, the tubing hanger 26 may be retrieved without removing the subsea tree 22, thereby substantially reducing the duration and costs associated with retrieving the tubing hanger 26. In addition, because the subsea tree 22 and the spool assembly 24 are separate components, the tree 22 and the spool assembly 24 may be run and/or retrieved independently of one another, thereby further reducing the duration and costs of maintenance operations. Furthermore, because the BOP 32 may be directly coupled to the spool assembly 24, the subsea tree 22 will not experience the bending moments present in vertical tree or spool tree configurations, in which the tree is sandwiched between the BOP 32 and the spool assembly 24 or wellhead hub 18. Consequently, the subsea tree 22 may employ a thinner, lighter and/or less expensive structure. Moreover, because the hub connection 42 and the mating hub connection 44 may be generic/universal, a single subsea tree design may be employed, thereby substantially reducing costs associated with particularly configuring spool trees for various wellhead hub configurations.

FIG. 2 is a cross-sectional side view of an embodiment of a spool assembly 24 and subsea tree 22 that may be used in the mineral extraction system 10 of FIG. 1. As previously discussed, the spool assembly 24 is configured to be positioned between the wellhead hub 18 and the BOP 32. Consequently, the spool assembly 24 includes a first end 46 configured to interface with the wellhead hub 18, and a second end 48 configured to interface with the BOP 32. The longitudinal passage 34 extends in an axial direction 45 between the first end 46 and the second end 48, thereby establishing a flow path through the spool assembly 24. In the present embodiment, a collet connector 50 serves to secure the first end 46 of the spool assembly 24 to the wellhead hub 18. In addition, a cap 52 similar to a tree cap is disposed within the longitudinal passage 34 between the tubing hanger 26 and the second end 48 to block fluid flow into and out of the spool assembly 24. As illustrated, the cap 52 includes a plug 54, such as a wireline plug, and a seal 56, such as a rubber o-ring, for example. As will be appreciated, the cap 52 may include a locking mechanism configured to secure the cap 52 to the longitudinal passage 34 of the spool assembly 24. Consequently, the cap 52 may be retrieved by releasing the locking mechanism, and then extracting the cap 52 from the passage 34. In addition, the plug 54 may be removable (e.g., via a wireline) to provide fluid communication with the longitudinal passage 34.

As previously discussed, the tubing hanger 26 is configured to support a tubing string 57 that extends down the well-bore 20 to the mineral deposit 14. As will be appreciated, an annulus 58 of the spool assembly 24 surrounds the tubing string 57, and may be filled with completion fluid. A plug 60 (e.g., wireline plug) disposed within the longitudinal passage 36 of the tubing hanger 26 serves as a barrier between the product extracted from the mineral deposit 14 and the completion fluid within the annulus 58. Consequently, the plug 60 may block the flow of fluid into and out of the tubing hanger 26. In addition, the tubing hanger 26 includes a seal 62 (e.g., rubber o-ring) disposed against the longitudinal passage 34 of the spool assembly 24 and configured to block fluid flow around the tubing hanger 26. The illustrated wellhead configuration also includes an isolation sleeve 64 disposed within the passage 34, and extending from the first end 46 of the spool assembly 24 to the wellhead hub 18. As illustrated, the isolation sleeve 64 includes a first seal 66 (e.g., rubber o-ring) in contact with the passage of the wellhead hub 18, and a second seal 68 (e.g., rubber o-ring) in contact with the passage 34 of the spool assembly 24. In this configuration, the isolation sleeve 64 may facilitate pressure testing of the seal between the wellhead hub 18 and the spool assembly 24. The isolation sleeve 64 may also serve as an additional barrier to block a flow of completion fluid from exiting the wellhead 12 through the interface between the spool assembly 24 and the wellhead hub 18.

Furthermore, the tubing hanger 26 includes a first seal 70 positioned adjacent to the passage 34 of the spool assembly 24, and located in a downward direction 71 from the lateral flow passage 38. The tubing hanger 26 also includes a second seal 72 positioned adjacent to the passage 34, and located in an upward direction 73 from the lateral flow passage 38. In the present embodiment, the seals 70 and 72 are configured to block flow of completion fluid into the lateral flow passage 38, and to block flow of product (e.g., oil and/or natural gas) into the annulus 58. Consequently, a flow path will be established between the tubing string 57 and the lateral flow passage 40 of the spool assembly 24, thereby facilitating the flow of product to the subsea tree 22. Specifically, product will flow from the tubing string 57 in the upward direction 73 into the longitudinal passage 36 of the tubing hanger 26. Because the plug 60 blocks the flow of product from exiting the tubing hanger 26, the product will be directed through the lateral flow passage 38 of the tubing hanger 26 and into the lateral flow passage 40 of the spool assembly 24. The product will then flow into the subsea tree 22 via the interface between the hub connection 42 and the mating hub connection 44. While the plug 60 serves to block the flow of product out of the tubing hanger 26, it should be appreciated that the plug 54 within the cap 52 serves as a backup seal to block product from exiting the spool assembly 24, thereby providing a dual barrier between the product and the environment.

In the present embodiment, the spool assembly 24 includes one or more valves 74, such as production valves, coupled to the lateral flow passage 40. It should also be appreciated that the term "production" as used to describe valve 74 is for convenience and that the valve 74 may be used to regulate flow in either direction and for injection as well as production. The production valve 74 is configured to control the flow of product between the spool assembly 24 and the tree 22. For example, the production valve 74 may be closed prior to retrieving the tree 22, thereby blocking the flow of product from entering the environment. Conversely, once the tree 22 has been run or lowered into position, the valve 74 may be opened to facilitate product flow to the subsea tree 22. While the present embodiment includes a valve 74, it should be appreciated that alternative embodiments may employ any suitable device (e.g., wireline plug) configured to substantially block production flow from the well 16 to the hub connection 42. As illustrated, with the hub connection 42 coupled to the mating hub connection 44, the lateral flow passage 40 of the spool assembly 24 is in fluid communication with a product flow passage 75 of the subsea tree 22. In the present embodiment, the hub connection 42 is coupled to the mating hub connection 44 with a clamp 77, such as a manual clamp or a hydraulic connector. Because the tree 22 is positioned radially outward (i.e., along the radial direction 47) from the spool assembly 24, the subsea tree 22 will not experience the bending moments present in vertical tree or spool tree configurations, in which the tree is sandwiched between the BOP 32 and the spool assembly 24 or wellhead hub 18. Consequently, a smaller and/or lighter clamp 77 may be employed, as compared to vertical tree or spool tree configurations. In addition, alternative embodiments may utilize other connectors, such as latches or fasteners, to secure the hub connection 42 to the mating hub connection 44.

In the present embodiment, the product flow passage 75 includes a first production valve 76 and a second production valve 78. As illustrated the first production valve 76 is positioned upstream of an annulus crossover valve 80, and the second production valve 78 is positioned downstream from the annulus crossover valve 80. As discussed in detail below, the valves 76, 78 and 80 may be controlled to vary fluid flow into and out of the annulus 58 and tubing string 57. In addition, the product flow passage 75 includes a choke 82 positioned downstream from the production valves 76 and 78, and configured to regulate pressure and/or flow rate of product through the product flow passage 75. The product flow passage 75 also includes a flowline isolation valve 84 configured to selectively block fluid flow between the tree 22 and the surface. As illustrated, the product flow passage 75 terminates at a flowline hub 86 configured to interface with a conduit or manifold that conveys the product from the wellhead 12 to a surface vessel or platform.

Figure 4:
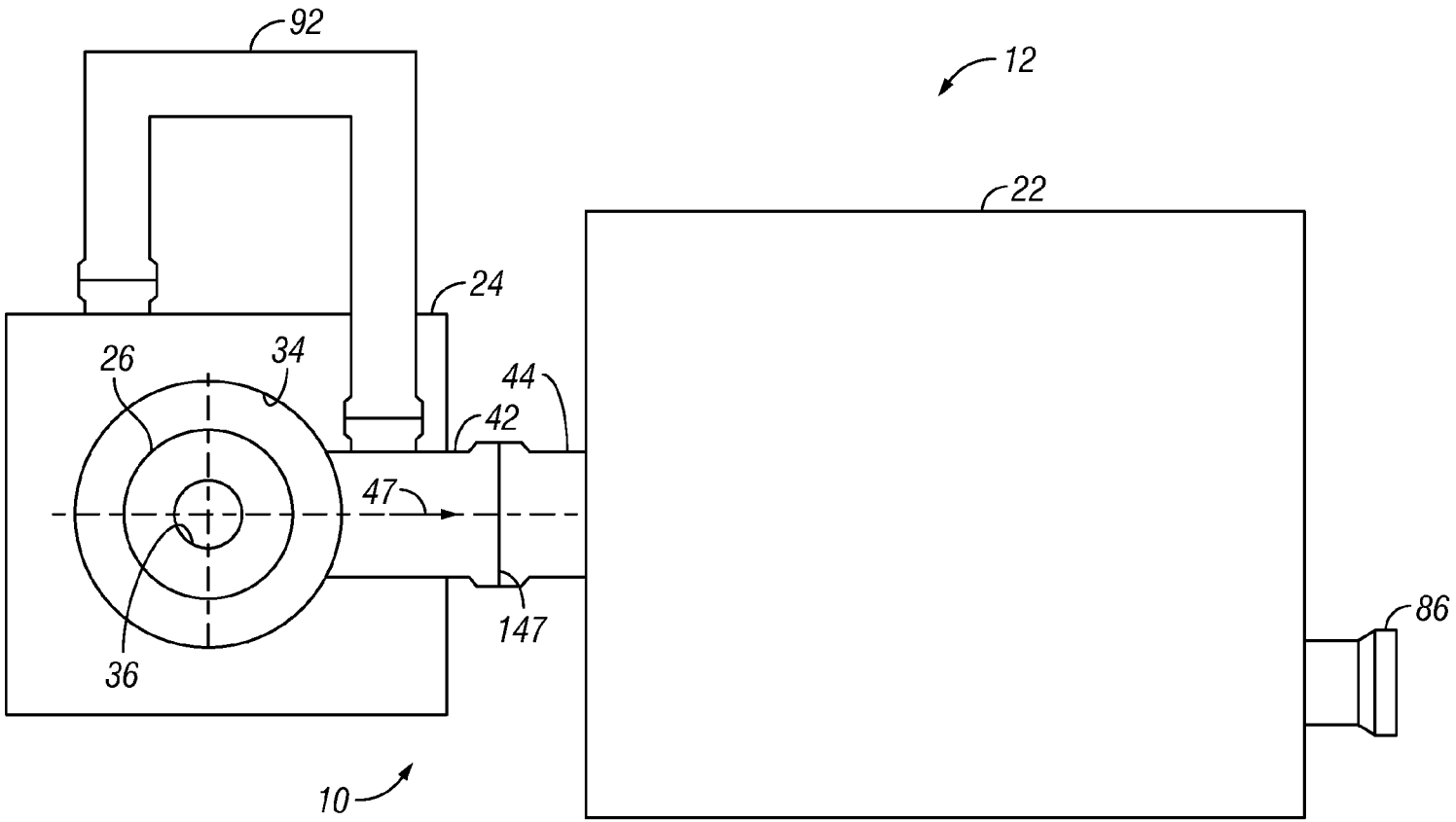
FIG. 4 is a top view of the spool assembly and subsea tree shown in FIG. 2.

Because the tubing hanger 26 is substantially sealed to the passage 34 of the spool assembly 24 via the seals 62, 70 and 72, flow of completion fluid through the annulus 58 is blocked. Consequently, the spool assembly 24 includes an upper annulus flow passage 88 and a lower annulus flow passage 90 to regulate completion fluid pressure within an upper region 89 above the tubing hanger 26 and a lower region 91 below the tubing hanger 26, respectively. Specifically, the upper annulus flow passage 88 extends from the upper region 89 to an annulus flow passage 92, and the lower annulus flow passage 90 extends from the annulus flow passage 92 to the lower region 91. The annulus flow passage 92 (as shown in FIG. 4) extends outside the spool assembly 24 through the sea water environment and then joins into the annulus flow passage 97 in the hub connection 42 or anywhere else on the spool assembly 24. The annulus flow passage 97 is capable of fluid communication with the product flow passage 75 by way of the annulus crossover valve 80 which is described in greater detail below. In this configuration, completion fluid may be supplied and/or removed from each region 89 and 91. In the present embodiment, the upper annulus flow passage 88 includes an upper annulus valve 94, and the lower annulus flow passage 90 includes a lower annulus valve 96. The valves 94 and 96 are configured to control fluid flow to the upper region 89 and lower region 91, respectively. For example, prior to retrieving the tree 22, the valves 94 and 96 may be closed to block the flow of completion fluid from the annulus 58 into the environment. Conversely, once the tree 22 has been run or lowered into position, the valves 94 and 96 may be opened to facilitate flow of completion fluid between the tree 22 and the spool assembly 24. In addition, when landing the cap 52, the lower annulus valve 96 may be closed to seal completion fluid within the lower region 91, and the upper annulus valve 94 may be opened to enable excess completion fluid to be drained from the upper region 89, thereby facilitating movement of the cap 52 in the downward direction 71.

As illustrated, an annulus flow passage 92 extends outside, or external, the spool assembly 24 through the sea water environment and interfaces with an annulus flow passage 97 of the hub connection 42 or anywhere else on the spool assembly 24, thereby establishing a completion fluid flow path between the spool assembly 24 and the subsea tree 22. In the present embodiment, the annulus flow passage 97 includes an annulus valve 98 positioned upstream of the annulus crossover valve 80, and an annulus monitor valve 100 positioned downstream from the annulus crossover valve 80. As will be appreciated, the annulus valves 98 and 100 may be controlled along with the production valves 76 and 78 and the annulus crossover valve 80 to adjust fluid flow to and from the annulus 58 and the tubing string 57. For example, if the annulus valve 98, the annulus monitor valve 100, the first production valve 76, and the second production valve 78 are in the open position, and the annulus crossover valve 80 is in the closed position, then a fluid connection will be established between the flowline hub 86 and the tubing string 57, and between an annulus junction 101 and the annulus 58. In this configuration, pressure within the annulus 58 may be monitored, increased and/or decreased from the surface, and product may flow to a surface vessel or platform through the flowline hub 86. In one alternative configuration, the annulus monitor valve 100, the annulus crossover valve 80 and the first production valve 76 may be transitioned to the open position, and the annulus valve 98 and the second production valve 78 may be transitioned to the closed position. As a result, product flow to the flowline hub 86 will be blocked. However, a fluid connection will be established between the annulus junction 101 and the tubing string 57. In this configuration, completion fluid may be pumped into the tubing string 57 and/or the pressure of the product may be measured. As will be appreciated, the valves 76, 78, 80, 98, and 100 may be transitioned to alternative positions to establish further flow path configurations.

In the present embodiment, the tubing string 57 includes a downhole valve 102, such as for example a surface-controlled subsurface safety valve (SCSSV) 102 configured to selectively block product flow to the subsea tree 22. For example, as an SCSSV, the valve 102 may be hydraulically operated and biased toward a closed position (i.e., failsafe closed) to ensure that the SCSSV closes if the system experiences a reduction in hydraulic pressure. With the downhole valve 102 and the production valve 74 in respective closed positions, two barriers are provided between the fluid flow and the environment, even when the tree 22 is removed. In the present embodiment, the downhole valve 102 is hydraulically controlled via a conduit 104 extending from the hub connection 42 to the valve 102. As illustrated, the conduit 104 connects with a conduit 110 within the subsea tree 22 when the hub connection 42 is mounted to the mating hub connection 44, thereby establishing a fluid connection between the conduit 104 within the spool assembly 24 and the conduit 110 within the subsea tree 22. The connection may be any type of sealing connection, such as a stab connection. The connection may also be configured to substantially block fluid flow into and out of the respective conduits 104 and 110 when disengaged. As illustrated, the conduit 110 is coupled to a valve 112 configured to selectively block hydraulic fluid flow to the downhole valve 102.

In the present embodiment, the spool assembly 24 also includes a vent/test conduit 114 configured to regulate fluid flow to certain regions of the tubing hanger 26. For example, during running operations, fluid may become trapped between various seals of the tubing hanger 26, thereby blocking movement of the hanger 26 in the downward direction 71. In such a situation, the vent/test conduit 114 may vent fluid from the affected region to enable the tubing hanger 26 to land properly within the passage 34 of the spool assembly 24. In addition, the vent/test conduit 114 may provide fluid flow to certain regions between the seals, thereby testing the integrity of the seals. As illustrated, the conduit 114 connects with a conduit 120 within the subsea tree 22 when the hub connection 42 is mounted to the mating hub connection 44, thereby establishing a fluid connection between the conduit 114 within the spool assembly 24 and the conduit 120 within the subsea tree 22. The connection may be any type of sealing connection, such as a stab connection. The connection may also be configured to substantially block fluid flow into and out of the respective conduits 114 and 120 when disengaged. As illustrated, the conduit 120 is coupled to a valve 122 configured to selectively block fluid flow to the vent/test conduit 114.

In the present embodiment, the spool assembly 24 also includes a chemical injection conduit 124 configured to inject chemicals, such as methanol, polymers, surfactants, etc., into the well-bore 20 to improve recovery. As illustrated, the conduit 124 connects with a conduit 130 within the subsea tree 22 when the hub connection 42 is mounted to the mating hub connection 44, thereby establishing a fluid connection between the conduit 124 within the spool assembly 24 and the conduit 130 within the subsea tree 22. The connection may be any type of sealing connection, such as a stab connection. The connection may also be configured to substantially block fluid flow into and out of the respective conduits 124 and 130 when disengaged. As illustrated, the conduit 130 is coupled to a valve 132 configured to selectively block the flow of chemicals into the well bore 20.

In the present embodiment, the spool assembly 24 also includes another hydraulic conduit 134 configured to operate a sliding sleeve within the tubing string 57. For example, the tubing string 57 may terminate in a first region of the mineral deposit 14 and the sliding sleeve may be aligned with a second region of the mineral deposit 14. In this configuration, when the sliding sleeve is in a closed position, the tubing string 57 may extract product from the first region. Conversely, when the sliding sleeve is in an open position, the tubing string 57 may extract product from the second region. Consequently, product may be selectively extracted from various regions of the mineral deposit 14 with a single tubing string 57. As illustrated, the conduit 134 connects with a conduit 140 within the subsea tree 22 when the hub connection 42 is mounted to the mating hub connection 44, thereby establishing a fluid connection between the conduit 134 within the spool assembly 24 and the conduit 140 within the subsea tree 22. The connection may be any type of sealing connection, such as a stab connection. The connection may also be configured to substantially block fluid flow into and out of the respective conduits 134 and 140 when disengaged. As illustrated, the conduit 140 is coupled to a valve 142 configured to selectively block hydraulic fluid flow to the sliding sleeve.

While the present embodiment includes four conduits 104, 114, 124 and 134 extending from the subsea tree 22 to the spool assembly 24, it should be appreciated that alternative embodiments may include more or fewer conduits. For example, certain embodiments may include additional valves controlled by additional hydraulic conduits, additional sliding sleeves controlled by additional conduits and/or additional chemical injection conduits.

As previously discussed, the present wellhead configuration enables the subsea tree 22 to be run and/or retrieved independently from the spool assembly 24. For example, to remove the tree 22, the SCSSV 102 and the production valve 74 may be transitioned to the closed position, thereby blocking a flow of product out of the spool assembly 24. In addition, the upper and lower annulus valves 94 and 96 may be transitioned to the closed position to block the flow of completion fluid out of the spool assembly 24. Next, the clamp 77 may be removed, thereby enabling the hub connection 42 and the mating hub connection 44 to separate from one another. Because the conduits 104, 114, 124 and 134 employ stab connectors, fluid flow into and out of the conduits will be blocked once the tree 22 is removed. Consequently, the tree 22 may be retrieved without substantial fluid leakage from the spool assembly 24. Because most of the valves configured to regulate flow to and from the wellhead 12 (e.g., all valves except the upper annulus valve 94, lower annulus valve 96 and production valve 74) are located within the subsea tree 22, the valves may be serviced without removing the spool assembly 24. Therefore, if valve maintenance is desired, the tree 22 may be pulled by a ship, thereby substantially reducing maintenance costs compared to spool tree configurations in which a rig is employed to retrieve the spool tree.

Similarly, the tubing hanger 26 may be retrieved without removing the subsea tree 22. For example, to remove the tubing hanger 26, the well-bore 20 may be plugged to block the flow of product into the environment. Next, the cap 52 may be removed to provide access to the tubing hanger 26. Finally, the tubing hanger 26 and attached tubing string 57 may be retrieved via a rig, for example. Because the subsea tree 22 does not block access to the longitudinal passage 34 of the spool assembly 24, the tree 22 may remain attached to the spool assembly 24 during the tubing hanger retrieval process. Consequently, maintenance costs may be significantly reduced compared to vertical tree configurations in which the vertical tree is removed prior to accessing the tubing hanger 26.

Figure 3:
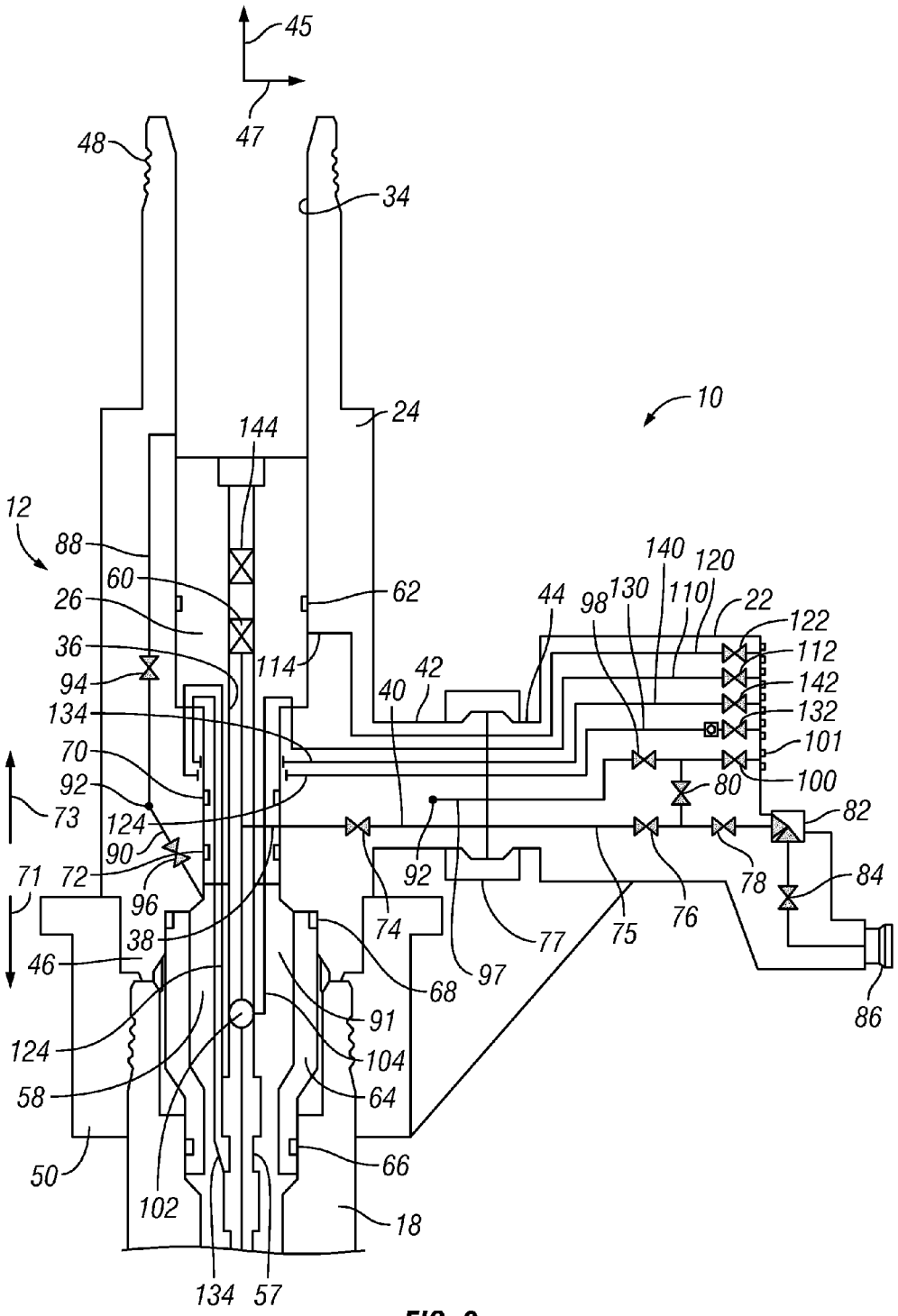
FIG. 3 is a cross-sectional side view of the spool assembly and subsea tree, as shown in FIG. 2.

FIG. 3 is a cross-sectional side view of the spool assembly 24 and subsea tree 22, as shown in FIG. 2, including two plugs within the tubing hanger 26. As illustrated, the cap 52 of the embodiment described above with reference to FIG. 2 has been replaced by a second plug 144 (e.g., wireline plug). In the present embodiment, the longitudinal passage 36 of the tubing hanger 26 has been extended along the axial direction 45 to accommodate the addition plug 144. The combination of the first plug 60 and the second plug 144 provides a dual barrier between the product flow and the environment. Consequently, the cap 52 and plug 54 shown in FIG. 2 may be obviated. Because the tubing hanger 26 is directly exposed to sea water in the present embodiment, the upper annulus flow passage 88 will not be in fluid communication with completion fluid once the tubing hanger 26 has been run. Therefore, the upper annulus valve 94 will be transitioned to the closed position after the tubing hanger running process is complete.

FIG. 4 is a top view of the spool assembly 24 and subsea tree 22 shown in FIG. 2. As illustrated, the subsea tree 22 is positioned radially outward (i.e., along the radial direction 47) from the spool assembly 24 such that the subsea tree 22 does not block the longitudinal passage 34. Consequently, the subsea tree 22 and the tubing hanger 26 may be run and/or retrieved independently of one another. In the present embodiment, the hub connection 42 and the mating hub connection 44 are configured to interface with one another along a plane 147 substantially parallel to the longitudinal passage 34 of the spool assembly 24. Consequently, to couple the subsea tree 22 to the spool assembly 24, the tree 22 may be lowered to the depth of the spool assembly 24 and then translated in a lateral direction 146 until the hub connection 42 interfaces with the mating hub connection 44. The hub connection 42 may then be clamped to the mating hub connection 44, thereby establishing the fluid connections described above with reference to FIG. 2.

In certain embodiments, the spool assembly 24 may be configured to interface with a particular wellhead hub 18, while employing a generic/universal hub connection 42. For example, a wide variety of spool assemblies 24 may be manufactured to interface with different wellhead hub sizes and/or shapes. However, each spool assembly 24 may employ a substantially identical hub connection 42. Consequently, each subsea tree 22 may employ a mating hub connection 44 configured to interface with the generic/universal hub connection 42. As a result, a single tree design may be utilized for a variety of spool assembly configurations, thereby substantially reducing the expense and/or duration of manufacturing subsea trees 22. In addition, because the subsea tree 22 does not directly interface with the wellhead hub 18, the tree 22 may omit the isolation sleeves and special seals configured to interface with numerous wellhead profiles, thereby further decreasing manufacturing costs.

Figure 5:
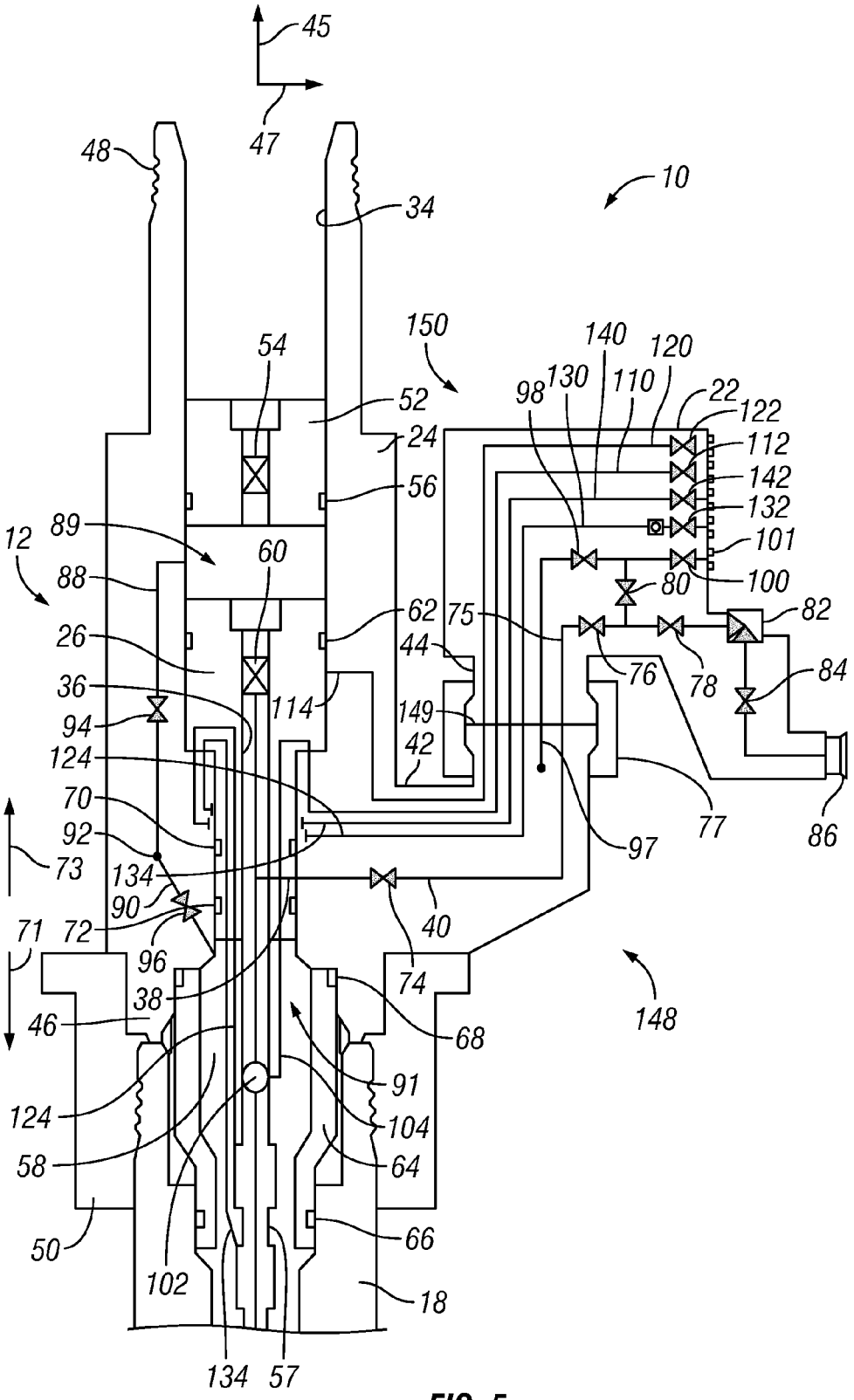
FIG. 5 is a cross-sectional side view of an embodiment of the spool assembly and subsea tree that may be used in the mineral extraction system of FIG. 1.

FIG. 5 is a cross-sectional side view of an embodiment of the spool assembly 24 and subsea tree 22 that may be used in the mineral extraction system 10 of FIG. 1. As illustrated, the hub connection 42 includes a substantially 90 degree bend 148 in the upward direction 73. Correspondingly, the mating hub connection 44 includes a substantially 90 degree bend 150 in the downward direction 71. As a result, the hub connection 42 interfaces the mating hub connection 44 along a plane 149 substantially perpendicular to the longitudinal passage 34 of the spool assembly 24. In this configuration, during the running process, the tree 22 may be lowered into position without the lateral movement described above with reference to the embodiment of FIGS. 2-4. As a result, the duration of the lowering process may be reduced, thereby substantially decreasing assembly costs. While a cap 52 is employed in the present embodiment, it should be appreciated that alternative embodiments may employ a tubing hanger 26 with a dual-plug configuration, such as the hanger 26 described above with reference to FIG. 3.

Figure 6:
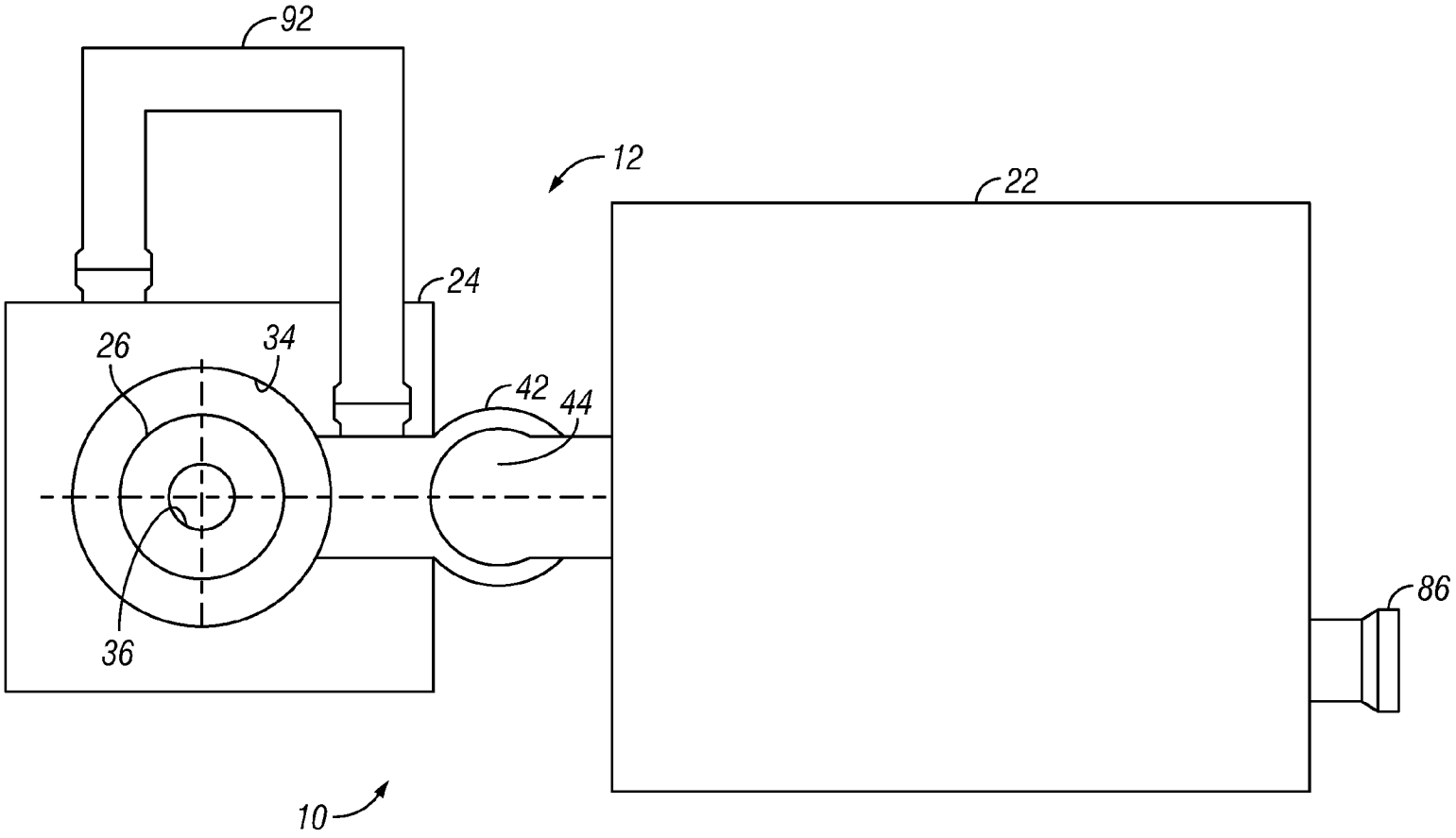
FIG. 6 is a top view of the spool assembly and subsea tree shown in FIG. 5.

FIG. 6 is a top view of the spool assembly 24 and subsea tree 22 shown in FIG. 5. As illustrated, the mating hub connection 44 is positioned above the hub connection 42, thereby enabling the tree 22 to be lowered into position without lateral movement. Consequently, the lowering operation may utilize less time and/or provide decreased costs compared to the embodiment described above with reference to FIGS. 2-4. Furthermore, it should be noted that because the subsea tree 22 is positioned radially outward from the spool assembly 24, the tree 22 and tubing hanger 26 may be run and/or retrieved independently of one another. In addition, because the subsea tree 22 does not include a longitudinal passage, the structure of the tree 22 may be thinner and/or lighter than vertical or horizontal tree configurations. Moreover, because the subsea tree 22 does not interface with a BOP 32 or a wellhead hub 18, the respective connectors may be omitted, thereby further decreasing the weight and/or expensive of the subsea tree 22. For example, due to the complexity and size of certain subsea tree configurations (e.g., spool trees), manufacturing may be restricted to a limited number of facilities in the world. As a result, such facilities may experience a significant backlog, thereby delaying production of the trees. By omitting the longitudinal passage, BOP connector and/or wellhead hub connector, the present embodiment may be manufacturing in a greater number of facilities, thereby potentially decreasing manufacturing costs and production duration.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system for producing well production fluids through a tubing hanger connected with a production tubing string, comprising:

a subsea tree comprising a production flow passage and a tree annulus flow passage;

a spool assembly separate from the subsea tree and comprising:

a body comprising a spool longitudinal passage configured to receive and support the tubing hanger, there being an annulus between the production tubing string and the body; and a lateral flow passage extending laterally from the spool longitudinal passage and configured to transfer the production fluids to the production flow passage; and an annulus flow passage in fluid communication with the annulus and extending externally from the spool assembly at a first location and reentering the spool assembly at a second location separate from the lateral flow passage.

2. The system of claim 1, wherein the annulus flow passage is in fluid communication with the tree annulus flow passage.

3. The system of claim 1, wherein the subsea tree does not include a high pressure wellhead housing connection.

4. The system of claim 1, wherein the subsea tree is positionable radially outward from the spool longitudinal passage.

5. A system for producing well production fluids with a tubing hanger supporting a tubing string with an annulus surrounding the tubing string, and a subsea tree, the system comprising:

a spool assembly comprising:

a spool longitudinal passage configured to receive and support the tubing hanger; and a lateral flow passage extending laterally from the spool longitudinal passage and configured to transfer the production fluids to the subsea tree; and an annulus flow passage in fluid communication with the annulus and extending externally from the spool assembly at a first location and reentering the spool assembly at a second location separate from the lateral flow passage.

6. The system of claim 5, further comprising the subsea tree comprising a tree annulus flow passage and wherein the annulus flow passage is in fluid communication with the tree annulus flow passage.

7. The system of claim 5, wherein the subsea tree does not include a high pressure wellhead housing connection.

8. The system of claim 5, wherein the subsea tree is positionable radially outward from the spool longitudinal passage.

9. A system for producing or injecting fluids into a well using a tubing string with an annulus surrounding the tubing string, comprising:

a subsea tree comprising a production flow passage and a tree annulus flow passage;

a spool assembly separate from the subsea tree and comprising:

a body comprising a spool longitudinal passage; and a spool lateral flow passage extending laterally from the spool longitudinal passage and configured to transfer the fluids to the production flow passage;

a tubing hanger landable within the spool longitudinal passage and comprising:

a hanger longitudinal passage; and a hanger lateral flow passage in fluid communication with the hanger longitudinal passage and the spool lateral flow passage; and an annulus flow passage in fluid communication with the annulus and extending externally from the spool assembly at a first location and reentering the spool assembly at a second location separate from the spool lateral flow passage.

10. The system of claim 9, wherein the annulus flow passage is in fluid communication with the tree annulus flow passage.

11. The system of claim 9, wherein the subsea tree does not include a high pressure wellhead housing connection.

12. The system of claim 9, wherein the subsea tree is positionable radially outward from the spool longitudinal passage.

* * * * *